US011452385B2

(12) United States Patent
Degrazia

(10) Patent No.: US 11,452,385 B2
(45) Date of Patent: Sep. 27, 2022

(54) DEVICES AND METHODS FOR SUPPORTING AND CONTAINING PREMATURE BABIES AND SMALL-FOR-AGE INFANTS

(71) Applicant: CHILDREN'S MEDICAL CENTER CORPORATION, Boston, MA (US)

(72) Inventor: Michele L. Degrazia, Lakeville, MA (US)

(73) Assignee: CHILDREN'S MEDICAL CENTER CORPORATION, Boston, MA (US)

( * ) Notice: Subject to any disclaimer, the term of this patent is extended or adjusted under 35 U.S.C. 154(b) by 101 days.

(21) Appl. No.: 16/854,425

(22) Filed: Apr. 21, 2020

(65) Prior Publication Data

US 2020/0268171 A1 Aug. 27, 2020

Related U.S. Application Data

(63) Continuation of application No. 15/570,651, filed as application No. PCT/US2016/030853 on May 4, 2016, now Pat. No. 10,667,627.

(60) Provisional application No. 62/157,094, filed on May 5, 2015.

(51) Int. Cl.

| | |
|---|---|
| ***A47D 13/08*** | (2006.01) |
| ***A47D 9/00*** | (2006.01) |
| ***A61G 7/07*** | (2006.01) |
| ***A61G 7/057*** | (2006.01) |

(Continued)

(52) U.S. Cl.

CPC ..... *A47D 13/08* (2013.01); *A47D 9/00* (2013.01); *A47D 13/083* (2013.01); *A47D 15/008* (2013.01); *A61G 7/05723* (2013.01); *A61G 7/07* (2013.01); *A61G 7/072* (2013.01); *A61G 11/00* (2013.01)

(58) Field of Classification Search

CPC .... A47D 13/08; A47D 13/083; A47D 15/008; A47D 9/00; A61G 7/07; A61G 7/072; A61G 7/05723; A47G 11/00

See application file for complete search history.

(56) References Cited

U.S. PATENT DOCUMENTS

| | | | | |
|---|---|---|---|---|
| 3,729,752 | A | 5/1973 | Huggins | 5/93.1 |
| 3,762,404 | A | 10/1973 | Sakita | 602/6 |
| 4,139,920 | A | 2/1979 | Evans | 5/655.4 |

(Continued)

FOREIGN PATENT DOCUMENTS

| | | |
|---|---|---|
| WO | WO/1999/001148 | 1/1999 |
| WO | WO/1999/059561 | 11/1999 |

(Continued)

OTHER PUBLICATIONS

Bruneteau, R. J. (1992) "Frontal plagiocephaly: synostotic, compensational, or deformational," *Plastic and Reconstructive Surgery* 89(1), 21-31; discussion 32-23.

(Continued)

*Primary Examiner* — David R Hare

(74) *Attorney, Agent, or Firm* — Medlen & Carroll, LLP

(57) ABSTRACT

Infant support devices and containment devices are described for use with premature and small-for-age infants, and in particular premature babies two kilograms or less, and even babies of one kilograms or less. The devices can be used separately or in combination (whereupon both support and containment are achieved together).

5 Claims, 19 Drawing Sheets

(51) Int. Cl.
*A61G 11/00* (2006.01)
*A47D 15/00* (2006.01)

(56) References Cited

U.S. PATENT DOCUMENTS

| | | | | |
|---|---|---|---|---|
| 4,281,425 | A | 8/1981 | Jacobs | 5/455 |
| 4,383,713 | A | 5/1983 | Roston | 297/219 |
| 4,607,403 | A | 8/1986 | Alivizatos | 5/449 |
| 4,631,766 | A | 12/1986 | Semmler et al. | 5/431 |
| 4,688,270 | A * | 8/1987 | Denicola | A61F 5/3784 2/69.5 |
| 4,761,843 | A | 8/1988 | Jay | 5/431 |
| 4,776,324 | A | 10/1988 | Clarren | 128/76 R |
| 4,825,487 | A | 5/1989 | Eberl | 5/464 |
| 5,009,318 | A | 4/1991 | Lepinoy | 206/524.8 |
| 5,038,312 | A | 8/1991 | Kojima | 364/736 |
| 5,094,229 | A | 3/1992 | Pomatto | 128/76 |
| 5,371,909 | A * | 12/1994 | McCarty | A47D 13/08 5/490 |
| 5,383,711 | A | 1/1995 | Houghteling | 297/397 |
| 5,392,785 | A * | 2/1995 | Donahue | A47D 13/08 128/873 |
| D370,586 | S | 6/1996 | Olah | D06/601 |
| 5,524,640 | A | 6/1996 | Lisak et al. | 128/846 |
| 5,551,108 | A | 9/1996 | Butler | 5/655 |
| 5,551,109 | A | 9/1996 | Tingley et al. | 5/655 |
| 5,581,832 | A | 12/1996 | Bridley | 5/655 |
| 5,586,351 | A | 12/1996 | Ive | 5/655 |
| 5,675,853 | A | 10/1997 | Linge | 5/655 |
| 5,778,470 | A | 7/1998 | Haider | 5/645 |
| 5,826,287 | A * | 10/1998 | Tandrup | A47D 15/008 5/655 |
| 5,915,503 | A | 6/1999 | Enright | 188/67 |
| 5,916,089 | A | 6/1999 | Ive | 5/655 |
| 5,996,152 | A * | 12/1999 | Wilson | A47D 15/008 5/640 |
| 6,006,381 | A | 12/1999 | Tandrup | 5/655 |
| 6,052,849 | A | 4/2000 | Dixon | 5/643 |
| 6,161,239 | A * | 12/2000 | Grazel | A47C 27/086 5/655 |
| 6,226,817 | B1 | 5/2001 | Rubio | 5/632 |
| 6,260,553 | B1 | 7/2001 | Mann | 128/898 |
| 6,266,832 | B1 | 7/2001 | Ezell | 5/640 |
| D448,227 | S | 9/2001 | Straub | D06/601 |
| 6,321,403 | B1 | 11/2001 | Matthews | 5/655 |
| 6,346,353 | B1 | 2/2002 | Wang | 430/202 |
| 6,421,855 | B2 | 7/2002 | Mann | 5/613 |
| 6,460,207 | B1 | 10/2002 | Papay | 5/640 |
| 6,473,923 | B1 | 11/2002 | Straub | 5/655 |
| 6,481,032 | B2 * | 11/2002 | Milano | A61J 17/1111 5/655 |
| 6,505,366 | B1 | 1/2003 | Lied | 5/655 |
| 6,564,408 | B2 | 5/2003 | Vuuren | 5/655 |
| 6,592,536 | B1 | 7/2003 | Argenta | 602/17 |
| 6,779,211 | B1 * | 8/2004 | Williams | A47D 13/08 5/640 |
| 6,966,089 | B2 | 11/2005 | Gold et al. | 5/655 |
| 7,059,000 | B2 | 6/2006 | Verbovszky | 5/655 |
| 7,445,281 | B2 | 11/2008 | Kassai | 297/219.12 |
| 7,513,001 | B1 * | 4/2009 | Leach | A47C 27/086 5/632 |
| 7,644,990 | B2 * | 1/2010 | Pearson | A47C 7/383 297/393 |
| 7,647,660 | B2 | 1/2010 | Tullous | 5/655 |
| 7,810,501 | B2 | 10/2010 | Rogers et al. | 128/845 |
| 7,850,595 | B2 * | 12/2010 | White | F16L 3/2235 600/22 |
| 8,186,354 | B2 | 5/2012 | Rogers et al. | 128/845 |
| 8,419,128 | B1 | 4/2013 | Leach | 297/219.12 |
| 8,671,486 | B1 | 3/2014 | Paperno | 5/655 |
| 8,832,864 | B1 * | 9/2014 | Braden | A41D 13/1272 2/114 |
| 8,898,841 | B2 | 12/2014 | Esch | 5/655 |
| 9,380,896 | B2 | 7/2016 | Carangelo | 2/69 |
| 9,549,865 | B2 | 1/2017 | Hiebert | 128/845 |
| 10,051,969 | B2 | 8/2018 | Galloway | 5/632 |
| 2001/0042269 | A1 | 11/2001 | Mann | 5/613 |
| 2002/0042954 | A1 | 4/2002 | Straub | 5/655 |
| 2002/0174488 | A1 | 11/2002 | Appleton | 5/731 |
| 2003/0033674 | A1 | 2/2003 | Mann | 128/845 |
| 2003/0145384 | A1 | 8/2003 | Stelnicki | 5/655 |
| 2003/0177563 | A1 * | 9/2003 | Reich | A41D 13/1263 2/75 |
| 2003/0195450 | A1 | 10/2003 | Argenta | 602/17 |
| 2004/0015118 | A1 | 1/2004 | Sklar et al. | 602/5 |
| 2004/0172762 | A1 | 9/2004 | Lenyo | 5/655 |
| 2005/0210592 | A1 | 9/2005 | Littlehorn et al. | 5/655 |
| 2010/0257653 | A1 | 10/2010 | Coates | 2/69.5 |
| 2016/0051430 | A1 | 2/2016 | Bader | 128/845 |
| 2018/0199731 | A1 | 7/2018 | Starr et al. | 5/603 |
| 2020/0345159 | A1 * | 11/2020 | Mighali | A47D 13/08 |

FOREIGN PATENT DOCUMENTS

| | | |
|---|---|---|
| WO | WO/2002/032410 | 4/2002 |
| WO | WO/2011/077401 | 6/2011 |

OTHER PUBLICATIONS

Peitsch, W. K. et al. (2002) "Incidence of Cranial Asymmetry in Healthy Newborns," *Pediatrics* 110(6), e72.

Pollack, I. F. et al. (1997) "Diagnosis and Management of Posterior Plagiocephaly," *Pediatrics* 99(2), 180-185.

PCT International Search Report of International Application No. PCT/US2016/030853 dated Oct. 30, 2017.

Bruneteau, R. J., (1992) "Frontal plagiocephaly: synostotic, compensational, or deformational," *Plast. Reconstr. Surg.* 89(1), 21-31; discussion 32-23.

* cited by examiner

DEVICES AND METHODS FOR SUPPORTING AND CONTAINING PREMATURE BABIES AND SMALL-FOR-AGE INFANTS

FIELD OF THE INVENTION

The present invention contemplates infant support devices and containment devices, and associated methods, for use with premature and small-for-age infants, as well as monitored, hospitalized infants with limited mobility of 1 year or less, and in particular premature babies two kilograms or less, and even babies of one kilograms or less. While not limited to any single application, certain embodiments of the infant support devices are particularly suited for use in the Neonatal Intensive Care Unit (NICU).

BACKGROUND

Deformational plagiocephaly occurs most often in infants of four months age or younger because (i) the skulls of young infants are still easily deformed; (ii) the calvaria are rapidly expanding against a flat surface; (iii) non-fixed cranial sutures make the skull more malleable, and iv) such infants are neuromuscularly immature and lack the coordination to shift their head position. If left uncorrected and the pressure remains continuously or repeatedly applied, the existing deformation will likely become permanent.

There are adaptable orthotic devices that can correct and/or prevent deformational plagiocephaly, especially if used before the infant is 4 months of age. For example, U.S. Pat. Nos. 7,810,501 and 8,186,354 describe embodiments utilizing a plurality of removable stacked layers that are taken out as the size of the baby increases (in the manner of layers of an onion). However, such devices are not ideal for very small babies.

SUMMARY OF THE INVENTION

The present invention contemplates infant support devices and containment devices, and associated methods, for use with premature and small-for-age infants, as well as monitored, hospitalized infants with limited mobility of 1 year or less, and in particular premature babies two kilograms or less, and even babies of one kilograms or less. While not limited to any single application, certain embodiments of the infant support devices are particularly suited for use in the Neonatal Intensive Care Unit (NICU). In one embodiment, the present invention contemplates infant support devices designed to reduce and/or treat pediatric development disorders; and is particularly directed to orthotic devices for preventing or correcting deformational posterior plagiocephaly and similar deformations in premature or small-for-age infants. This includes all forms of plagiocephaly (including dolichocephaly, scaphocephaly, generalized plagiocephaly and brachycephaly) experienced by hospitalized infants.

A method for supporting an infant (e.g. premature infant), comprising: a) providing a support device (e.g. configured and used as a bed, pad, pillow or mattress) comprising i) a bottom enclosure comprising a bottom (or back) surface and a shape-adjustable fabric surface, said bottom surface joined with said fabric surface so as to comprise a defined region and a surrounding region, said surrounding region comprising discrete compressible (and moveable) materials retained therein with, said defined region lacking discrete compressible materials and surrounded by said surrounding region, ii) a top enclosure attached to said bottom enclosure, said top enclosure comprising a fabric contact surface and a flap for closing the top enclosure, iii) a layer of foam (e.g. solid polymer) material positioned inside the support device between said contact surface of said top enclosure and said shape-adjustable surface of said bottom enclosure, said layer comprising a concave head cavity, said head cavity aligned above (e.g. over) said defined region; b) placing an infant (e.g. premature infant) into said support device, such that said infant's torso contacts said fabric contact surface above said surrounding region and said infant's head contacts said fabric contact surface above said head cavity; and c) moving said discrete compressible materials to adjust the shape of said shape-adjustable surface so as to create a boundary around at least a portion of said infant. It is not intended that the present invention be limited by the nature of the boundary. In one embodiment, said boundary conforms to the dimensions of at least said portion of said infant. In one embodiment, said boundary conforms to the dimensions of at least a portion of said foam layer. It is contemplated that, in a preferred embodiment, a raised boundary will retain its shape (e.g. remained raised) until the boundary is changed (e.g. by a nurse, assistant, or other staff member). As noted previously, the infant may be premature (e.g. weighing 1 kilogram or less) or a small-for-age infant, or an infant with minimal mobility less than 1 year of age in need of a proper support surface. In one embodiment, said discrete compressible materials comprise compressible beads. In one embodiment, said bottom enclosure has no openings and said compressible beads are contained in said surrounding region. In one embodiment, the bottom enclosure comprises an opening through which an internal bladder can be inserted and removed, the bladder comprising compressible beads, the opening being closeable (e.g. a zipper on a seam, Velcro™ patch, loop, or seam, etc.). In a preferred embodiment, the bladder has no openings and is waterproof or at least highly water resistant (so that it can be wiped down) and stretchable. In one embodiment, the bladder is removed from the device when the remaining device is cleaned (e.g. in a washing machine) and the bladder is wiped down with chemically (bactericidal) treated cloths. In one embodiment, said beads comprise elastomeric polymer. In one embodiment, said beads comprise thermoplastic elastomeric polymer. In one embodiment, the bladder is made of a polymer-coated fabric, such as those available from Chemtick, Hicksville, N.Y. (USA). In one embodiment, the coated fabric is ChemCare Corona Plus HHR.

While not intending that the present invention be limited to the nature of shape of the defined region, in one embodiment said defined region is circular in shape. In another embodiment, said defined region is square in shape. In another embodiment, said defined region is elliptical in shape.

While not intending to limit the present invention to an infant support device of a particular shape or with a particular number of sides, in one embodiment, the back (bottom) surface is joined to (e.g. by sewing, knitting, or border stitching) said contact surface on three sides, with an opening on a fourth side for inserting said foam layer. In one embodiment, said fourth side can be closed by folding the bottom or contact surface over the other (in order to keep the insert in place). In one embodiment, said boundary of step c) is internal to at least one of said four sides.

It is not intended that the present invention be limited to the types of closures used to secure the contents of the pockets. Zipper and Velcro might be used; however, these are not preferred for several reasons. Zippers could serve as potential skin irritants, cause injury, and/or become damaged over time. Velcro can get caught on and damage fabric when being washed. An alternate closure was sought.

In a preferred embodiment, the pellets or beads are permanently sewn into the device, but can be moved so as to create a boundary. It is not intended that the present invention be limited by the nature, shape or height of the boundary—or how much (or what part) of the infant is contacted by the boundary. However, in one embodiment, the boundary of step c) is positioned (by hand) around said infant's head. In another embodiment, the boundary of step c) is positioned (by hand) around said infant's torso. In one embodiment, said boundary of step c) rises at least one quarter inch (and more preferably one half inch) above the remainder of the surrounding region (or at least the immediate surrounding region) of said contact surface. The width of the boundary can vary from one quarter inch to one half inch to three quarters of an inch or more (and need not be any precise dimension). In a preferred embodiment, the width and height of the boundary will remain as initially positioned until such time as it is re-positioned. As an infant is moved into and out of the support device, it is contemplated that nurses or other staff will adjust the adjustable contact surface so as to conform to the baby's size/dimensions.

In one embodiment, said top enclosure is joined to said bottom enclosure on three sides, with an opening on a fourth side for inserting said foam layer. In one embodiment, said boundary of step c) is internal to at least one of said four sides. In one embodiment, the boundary of step c) is positioned around said infant's head. In one embodiment, the boundary of step c) is positioned around said infant's torso. In one embodiment, said boundary of step c) rises at least one half inch above the remainder of the surrounding region of said contact surface.

The infant support device can be pretreated prior to introducing the infant, i.e. prior to step b). For example, it can be washed prior to step b). In one embodiment, said bed is warmed prior to step b) (e.g. with a warming light or by placement inside the isolette).

In one embodiment, said premature infant is placed into said bed in step b) face up. In one embodiment, the method further comprises the steps of d) lifting said infant off of said contact surface, e) removing said foam layer from inside the bed, and f) inserting a new foam layer into said bed, wherein said new foam layer has a larger head cavity. In one embodiment, the method further comprises g) placing said infant back on said contact surface of said bed.

The present invention also contemplates devices. In one embodiment, the present invention contemplates an infant support device (e.g. configured and used as a bed, pad, pillow or mattress) comprising i) a bottom enclosure comprising a bottom (or back) surface and a shape-adjustable fabric surface, said bottom surface joined with said shape-adjustable surface so as to comprise a defined region and a surrounding region, said surrounding region comprising discrete compressible (and moveable) materials retained therein with, said defined region lacking discrete compressible materials and surrounded by said surrounding region, ii) a top enclosure attached to said bottom enclosure, said top enclosure comprising a fabric contact surface and a flap for closing the top enclosure, and iii) a layer of foam material (e.g. solid polymer) positioned inside the infant support device between said contact surface of said top enclosure and said shape-adjustable surface of said bottom enclosure, said layer comprising a concave head cavity aligned above said defined region. In one embodiment, said discrete compressible materials comprise compressible beads. In one embodiment, said beads comprise elastomeric polymer. In one embodiment, said beads comprise thermoplastic elastomeric polymer. In one embodiment, said defined region is circular in shape. In one embodiment, said bottom enclosure is joined to said contact surface of said top enclosure on three sides, with an opening on a fourth side for inserting said foam layer. In one embodiment, said contact surface of said top enclosure is joined to said shape-adjustable surface of said bottom enclosure by sewing, stitching or knitting.

In one embodiment, the present invention contemplates an infant containment device comprising i) first and second individually moveable outer arms connected through a middle piece, ii) first and second individually moveable inner arms connected to said middle piece at first and second junctions, said first and second junctions separated by a space equal to at least half the width of said first or second inner arms, wherein said inner and outer arms comprise compressible (and moveable) material covered in fabric. In one embodiment, said compressible materials comprise compressible beads. In one embodiment, said beads comprise elastomeric polymer. In one embodiment, said beads comprise thermoplastic elastomeric polymer.

In one embodiment, the present invention contemplates a method of containing an infant comprising a) providing an containment device comprising i) first and second individually moveable outer arms connected through a middle piece, ii) first and second individually moveable inner arms connected to said middle piece at first and second junctions, said first and second junctions separated by a space equal to at least half the width of said first or second inner arms, wherein said inner and outer arms comprise compressible (and moveable) material covered in fabric; b) placing said containment device on top of an infant, such that said infant's feet are positioned in said space between said first and second junctions, said infant's torso contacts at least one of said inner arms and the top of said infant's head makes contact with said device without covering the face (or alternatively, it makes no contact with the infant's head); and c) moving said outer arms so as to create a boundary around at least a portion of said infant. In one embodiment, said infant has an IV line comprising tubing and said inner arms and outer arms are positioned so as to avoid and make no contact with said IV line. In one embodiment, the method further comprises d) introducing an IV line into said infant after step c).

The present invention also contemplates, in one embodiment, combining infant containment devices with infant support devices. In one embodiment, the present invention contemplates a system comprising an infant containment device positioned on top of an infant support device, said infant support device comprising i) a bottom enclosure comprising a bottom surface and a shape-adjustable fabric surface, said bottom surface joined with said shape-adjustable surface so as to comprise a defined region and a surrounding region, said surrounding region comprising discrete compressible (and moveable) materials retained therein with, said defined region lacking discrete compressible materials and surrounded by said surrounding region, ii) a top enclosure attached to said bottom enclosure, said top enclosure comprising a fabric contact surface and a flap for closing the top enclosure, and iii) a layer of foam material positioned inside the infant support device between said contact surface of said top enclosure and said shape-adjustable surface of said bottom enclosure, said layer comprising a concave head cavity aligned above said defined region; said infant containment device positioned on said contact surface and comprising a) first and second individually moveable outer arms connected through a middle piece, b) first and second individually moveable inner arms connected to said middle piece at first and second junctions, said first and second junctions separated by a space equal to at least half the width of said first or second inner arms, wherein said inner and outer arms comprise compressible (and moveable) material covered in fabric.

It is not intended that the present invention be limited by the precise positioning of the infant at step b). In one embodiment, said premature infant is placed into said bed in step b) face up. In another embodiment, the infant is placed on his/her side. In another embodiment, the foam insert is removed, allowing for the infant on cardiovascular monitoring to be placed prone with the head positioned on one side or the other (but not face down).

In a preferred embodiment, the layer of solid foam insert is removable. Therefore, in one embodiment, the present invention contemplates the above-specified method having additional steps, e.g. a method further comprising the steps of d) lifting said infant off of said contact surface, e) removing said (first) foam layer from inside the bed, and f) inserting a new (second) foam layer into said bed, wherein said new foam layer has a larger head cavity (than the dimensions of the head cavity of said first foam layer). In one embodiment, the method further comprises g) placing said infant back on said contact surface of said device (e.g. bed, pad, pillow or mattress).

As noted above, the present invention also contemplates infant containment devices. Such containment devices can be used independently or together with the herein-described infant support devices. In one embodiment, the device comprises two long tubular shapes comprising a single opening in the middle where they are sewn together, creating four moveable arms. The connection of the two tubular shapes allows for adjustments to be made by hand, shifting more internal contents to one area or the other to achieve a desired shape or effect (e.g. more heavily weighted in one area or the other). In one embodiment, the size of the connection is double the width of a single arm (both in length and width).

In one embodiment, the present invention contemplates an infant containment device comprising i) first and second individually moveable outer arms (i.e. the movement of one arm does not dictate the movement of another) connected through a middle piece, ii) first and second individually moveable inner arms connected to said middle piece at first and second junctions, said first and second junctions separated by a space equal to at least half the width of said first or second inner arms (and more preferably the approximate width of one of the arms), wherein said inner and outer arms comprise compressible material covered in one or two layers of fabric, textile or cloth. In one embodiment, the compressible material is contained within a bladder, the bladder being inserted into the arms of the containment device. In one embodiment, the bladder is made of a polymer-coated fabric, such as those available from Chemtick, Hicksville, N.Y. (USA). In one embodiment, the coated fabric is Chem-Care Corona Plus HHR. The first and second outer arms, together with the middle piece, can be fabricated as a single continuous unit if desired. In one embodiment, the junctions for the inner arms have less internal material so as to readily permit bending at the junctions (although this is completely adjustable).

The first and second inner arms can be crossed over the baby to secure the baby from large movement (e.g. in order to steady the baby to perform a procedure, such as putting in an intravenous (IV) line). The outer arms can be used to create a boundary to reduce the chance of the baby sliding or migrating out of or off of an infant support device (e.g. bed, pad, pillow or mattress). Again, it is not intended that the device be limited to the precise compressible materials. However, in one embodiment, said discrete compressible materials comprise compressible beads. In one embodiment, said beads comprise elastomeric polymer. In a preferred embodiment, said beads comprise thermoplastic elastomeric polymer.

The present invention contemplates a variety of methods for using the containment device. In one embodiment, the present invention contemplates a method of containing an infant (e.g. premature baby or small-for age infant) comprising a) providing an containment device comprising i) first and second individually moveable outer arms connected through a middle piece, ii) first and second individually moveable inner arms connected to said middle piece at first and second junctions, said first and second junctions separated by a space equal to at least half the width of said first or second inner arms, wherein said inner and outer arms comprise compressible material covered in fabric; b) placing said containment device on top of an infant (e.g. the infant might be already be positioned in an infant support device as described herein), such that said infant's feet are positioned in said space between said first and second junctions, said infant's torso contacts at least one of said inner arms and the top of said infant's head makes contact with said device (or alternatively, makes no contact with the head); and c) moving said outer arms so as to create a boundary around at least a portion of said infant. In one embodiment, said infant has an IV line comprising tubing and said inner arms and outer arms are positioned so as to avoid and make no contact with said IV line. In another embodiment, the device is used to control the movement of the baby prior to a procedure. For example, in one embodiment, the method further comprises d) introducing an IV line into said infant after step c), i.e. after the baby has been contained.

It is preferred that the containment device can be easily removed from (e.g. lifted off of) the support device. For this reason, it is preferred that the containment device not be attached to the support device. On the other hand, the weight of the containment device is such that it is maintained in place until moved by hand and separated from the support device.

GENERAL DESCRIPTION OF THE INVENTION

The present invention contemplates infant support devices and containment devices for use with premature and small-for-age infants, as well as monitored, hospitalized infants with limited mobility of 1 year or less, and in particular premature babies two kilograms or less, and even babies of one kilograms or less. While not limited to any single application, certain embodiments of the infant support devices are particularly suited for use in the Neonatal Intensive Care Unit (NICU). The support devices are contemplated for smaller, premature babies or small-for age infants as a bed, pad, support or mattress. The preferred embodiment lacks a hard base substrate. Instead of a hard plastic base with the foam layers on top, a softer substrate (e.g. fabric, textile or cloth substrate) more of the nature of a pillow (i.e. permitting pressure distortion) is employed. In a preferred embodiment, firmness comes from a foam insert (that permits less pressure distortion). The slightly compressible internal contents (e.g. beads) support the foam insert as well as the infant when the foam insert is removed.

The enhancement came from the recognition that premature babies (particularly those approximately 1 kilogram or less) don't fit very well into presently available devices and available "hard" surfaces tend to misshape the baby's head.

The need for proper support is great because premature and small-for-age babies are more likely to have an unusual head shape because their skulls are less developed and because they spend more time in bed. Moreover, the care for a premature infant can involve problems from positioning the premature infant due to restrictions (e.g. restrictions related to neurological immaturity and illness). For example, as a consequence of the positioning of the head continually in one side position, a premature infant will suffer from the flattening of that side of the head.

In one embodiment, the present invention contemplates a pillow-like device comprising an outer cover (e.g. that is made of cloth or other fabric) and two pockets or enclosures, the first pocket configured to hold a foam insert, the second pocket filled with soft, compressible (squishy), material (beads or pellets). In one embodiment, the top surface of the bottom enclosure serves as the floor of the top enclosure (so as to allow for fewer layers). The molded foam insert is configured to cradle the infant's head and body, facilitating development of a normalized head shape, while also providing support for the infant's torso. The soft squishy pellet filling in the second pocket provides a) support to the insert, b) a source for moldable boundaries around the infant (an important aspect for comforting the neonatal patient), and c) a soft place to lay the infant when the foam insert is removed and the infant is placed prone. A small amount of batting in the head area of the second pocket serves to provide a gentle surface for the infant's head when prone.

Materials used in the construction of the device are soft and friendly to the premature infant's skin. The weight of the device, derived from its pellet filler, keeps the device stationary when placed on a surface (e.g. in the infant's bed).

In one embodiment, at least a portion of the infant support device is compressible. In one embodiment, the present invention contemplates an infant support device comprising discrete moveable materials (such as compressible beads or other compressible particles) positioned inside a fabric, textile or cloth. This allows nurses (or other staff members) to "mold" or shape the support (by hand) to fit the particular size of the baby (and more specifically the size of the baby's head). In a preferred embodiment, there is a defined region with a boundary (created by sewing a circle, see FIG. 3) into which no moveable materials can enter. This avoids the problem of variable surfaces where the head contacts the device. The defined area can have a layer (or more) of cloth batting to further cushion the baby's head.

The filler (e.g. beads) is selected so as to provide a soft surface upon which infants can lay. It should be safe for use with human beings/infant, washable at high temperatures, durable (e.g. it retains shape/function). Is preferred that the material be made in US or country with similarly high standards.

DETAILED DESCRIPTION OF THE INVENTION

The present invention contemplates infant support devices and containment devices for use with premature and small-for-age infants, as well as monitored, hospitalized infants with limited mobility of 1 year or less, and in particular premature babies two kilograms or less, and even babies of one kilograms or less. While not limited to any single application, certain embodiments of the infant support devices are particularly suited for use in the Neonatal Intensive Care Unit (NICU). The support devices are contemplated for smaller, premature babies or small-for age infants as a bed, pad, support or mattress.

In a preferred embodiment, the device comprises a layer (of solid material) inserted and retained inside the device. It is preferred that this layer is a single layer (but if additional firmness is desired additional layers can be added) of polymer foam (e.g. Styrofoam brand polystyrene foam). Importantly, this layer is removable and inserted inside the bed to give the growing cranium structure and support, while concurrently maintaining the infant in a neutral position. The layer can be removed as the baby grows and be replaced by a layer having different (e.g. larger) dimensions. The layer is removed easily by, in one embodiment, folding back the bottom side or edge of the infant support device (see FIGS. 5A-C). While it is not intended that the present invention be limited to the precise thickness of the insert, each individual material insert employed may range from 2-10 mm (and more commonly 4-6 mm) in thickness. In one embodiment, the insert is 0.25 inches in thickness (6.35 mm).

In a preferred embodiment, the single insert comprises a head cavity of determined dimensions (FIG. 4). For example, in one embodiment, the insert comprises a head cavity (with dimensions in the lower range) measuring 7 cm wide, 8 cm tall, and 0.4 cm deep, or more preferably 8 cm wide, 8.5 cm tall, and 0.5 cm deep, and still more preferably 8.8 cm wide, 9.0 cm tall, and 0.6 cm deep (from upper cervical spine to occipital prominence). These dimensions represent the anatomically correct size ranges for a premature or small-for-age infant. By contrast, a head cavity measuring 9.4 cm wide, 9.3 cm tall, and 0.9 cm deep (from upper cervical spine to occipital prominence) represents the correct size for an average term infant. A head cavity measuring 10.0 cm wide, 9.6 cm tall, and 1.2 cm deep (from upper cervical spine to occipital prominence) represents the correct size for an average term infant of approximately 4 weeks of age. A head cavity measuring 10.6 cm wide, 9.9 cm tall, and 1.5 cm. deep (from upper cervical spine to occipital prominence), represents the correct size for an average term infant of approximately 8 weeks of age (the upper range). The present invention contemplates a series of inserts comprising a head cavity with increasing dimensions (but within the lower and upper ranges described above), such that once an infant outgrows an insert, it can be removed and replaced with an insert comprising a head cavity with larger dimensions.

In one embodiment, one of three insert layers is used inside the device. Inserts that are 14 inches long and 9.25 inches wide are provided by Boston Brace, Avon Mass. (USA). The depression width is approximately 3 inches wide. The deepest point of the depression measures approximately 1 inch (first layer), 1.25 inch (second layer) and 1.5 inch deep (third layer). It is preferred that each insert layer is used as a single layer; however, in one embodiment, more than one insert layer is used.

In one embodiment, the custom molding or shaping of the contact surface of the infant support device (by virtue of the moveable material therein) can be performed (by hand) so as to generate a slanted or inclined bed, pad or mattress at a desired angle from the top (where the head is positioned) to bottom (where the feet are positioned). The angle of the incline need not be great (e.g. between 0 and 20 degrees).

In a preferred embodiment, the manufactured infant support device comprises a contact surface that is repeatedly adjustable with a concave-shaped portion as a resting surface for a premature infant's head in a manner that effectively eliminates uneven pressure on the infant's occiput (when placed in a supine, or face up, position) and reduces pressure on the infant's temporal bone (when placed on the infant's side). By reducing pressure, the infant support device of the present invention will reduce the incidence of head flattening and head elongation. Where the infant already shows some head flattening or head elongation, it is contemplated that use of the infant support device of the present invention will provide a measure of anatomical correcting.

The "molding" or "shaping" of the device by virtue of the moveable materials, as well as the one insert, provide the infant with a personalized custom fit. As the infant grows and develops over time, this growth can be accommodated easily by adjusting the "molding" or "shaping" around the infant resting in the device (i.e. shaping the contact surface of the infant support device) and/or by replacing the insert with an insert that has a larger head recess. Unlike a fixed surface (whose dimensions cannot be changed), the moveable materials can be continually adjusted to account for infant movement and changes in infant positioning.

The infant support device of the present invention is durable and biocompatible. In addition, since the moveable materials are contained within the device, the device (once the insert is removed) can be washed as a unit with powdered detergent (the beads do not melt in the wash). Indeed, the infant support device can even be bleached. This allows for the use of one bed, pad, pillow or mattress over many weeks or months as the infant grows.

The infant support device of the present invention can be heated to a comfortable temperature for a premature baby or small-for-age infant. While not intending to be limited to the particular mode by which the device is heated, a simple approach of heating is to simply expose the device (or at least the contact surface of the device) to a warming light. Such warming lights (using either radiant heat or infrared) are commercially available and are typically part of the NICU. Small babies, such as premature babies 1 kilogram or less, have a large surface area compared to their volume, and little body fat. For this reason, they typically cannot maintain their own temperature. The present invention contemplates using a source of heat directed toward the device or at least the contact surface of the device. Many commercially available warming lights come with a thermostat hooked up to a sensor, permitting the power to be adjusted up and down dynamically. Such an arrangement can be used to pre-warm the device before the infant makes contact with it (e.g. with the thermostat positioned on the contact surface of the present device) so that the warming light delivers whatever heat is necessary to keep the contact surface at the desired temperature. In this manner, the premature infant can be introduced into a pre-warmed device. The warming light can then be used after the infant is positioned in the device, with the thermostat re-positioned on the baby to ensure the correct level of heat is delivered to the infant. Alternative, the device may be placed in the isolette to prewarm to the desired preset temperature.

When a baby is relatively stable but still premature or requiring intravenous fluids or other special attention, he or she may be cared for in an "incubator" or "isolette," The incubator keeps the baby warm with moistened air in a clean environment, and helps to protect the baby from noise, drafts, infection, and excess handling. In one embodiment, the infant support device of the present invention is contemplated for use inside the incubator. The infant support device can be pre-warmed by the incubator prior to introducing the infant into the device.

A transport incubator is used when a premature baby is moved from one hospital to another (e.g. from a community hospital to a larger medical center that has a neonatal intensive care unit). The transport incubator usually has a miniature ventilator (respirator), cardio-respiratory monitor, IV pump, pulse oximeter, and oxygen supply built right into its frame. A specially-trained physician, nurse, and respiratory therapist typically accompany the baby during the move. In one embodiment, the infant support device of the present invention is contemplated for use inside the transport incubator.

Every feeding, IV solution, and medication is calculated and based on the baby's weight. For this reason it is important that the weight be accurate, up-to-date, and readily available at all times. It is common in the NICU to weigh each baby at the same time and in the same way each day, and then chart the weight on the baby's chart. In one embodiment, the present invention contemplates moving the infant support device with the infant positioned in it to the scale for weighing. The weight is carefully corrected for the weight of the infant support device. Alternatively, the infant is moved from a first infant support device (as described herein) to a second infant support device positioned on the scale (which may be pre-warmed) for weighing.

A variety of compressible materials can be used. However, polymer beads are preferred. In particular, elastomeric beads or thermoplastic elastomeric beads (e.g. Thermolast™ from Kraiburg TPE) are used. In one embodiment, the pellets size is 108 per gram.

Thermoplastic elastomers consist of thermoplastic end blocks and an elastic midblock. As regards to their structure and behavior, they belong to a material class that is positioned between plastics (thermoplastics) and rubber (elastomer) and have gradually been developed into a material class of their own. TPEs show elastic properties that are similar to those of elastomers, while allowing for repeat deformation and recovery. This material is elastic at low temperatures (to −42° C.) and high thermal stability (to 125° C.), and retains its shape at low and high temperatures. The material shows excellent resistance against UV light, ozone and weather damage. The material is approved for drinking water applications and is free of latex and PVC. The material is toxicologist approved.

While the present invention is not limited to the precise nature of the TPE, those based on styrene block copolymers are contemplated in one embodiment. These are commercially available. For example, Kraiburg TPE produces mainly SEBS (styrene-ethylene-butylene-styrene) compounds. In this material, styrene end blocks are attached to an elastic or elastomeric segment (e.g. ethylene-butylene).

The fabric, textile or cloth used for the support device or containment devices described herein may be made of a variety of materials and/or combination of materials. In one embodiment, the fabric is cotton, such as organic cotton. A number of fabrics are contemplated for device construction depending upon the environment or age of patients that that will be using the device (e.g. cotton, jersey, fleece and soft water repellent fabrics). For use with the extremely low birth weight patients in the Neonatal Intensive Care Unit a soft, stretchy, cotton spandex blend fabric is preferred for the device cover. It was a challenge to find a fabric that could withstand washing in warm to hot water temperatures and bleaching. However, it was found that a fabric of 92% Organic Cotton/8% Spandex or 90% Organic Cotton/10% Spandex works well. The preferred fabric is 90% Organic Cotton/10% Spandex. The fabric washes well in warm water, can be bleached and tolerates drying at high temperatures. Such fabrics are commercially available from ECLAT Textile Company, with offices in Taiwan and Los Angeles, Calif.

DESCRIPTION OF PREFERRED EMBODIMENTS

The present invention contemplates infant support devices and containment devices for use with premature and small-for-age infants, and in particular premature babies two kilograms or less, and even babies of one kilograms or less. While not limited to any single application, certain embodiments of the infant support devices are particularly suited for use in the Neonatal Intensive Care Unit (NICU). The support devices are contemplated for smaller, premature babies or small-for age infants as a bed, pad, support or mattress.

Figure 1A:
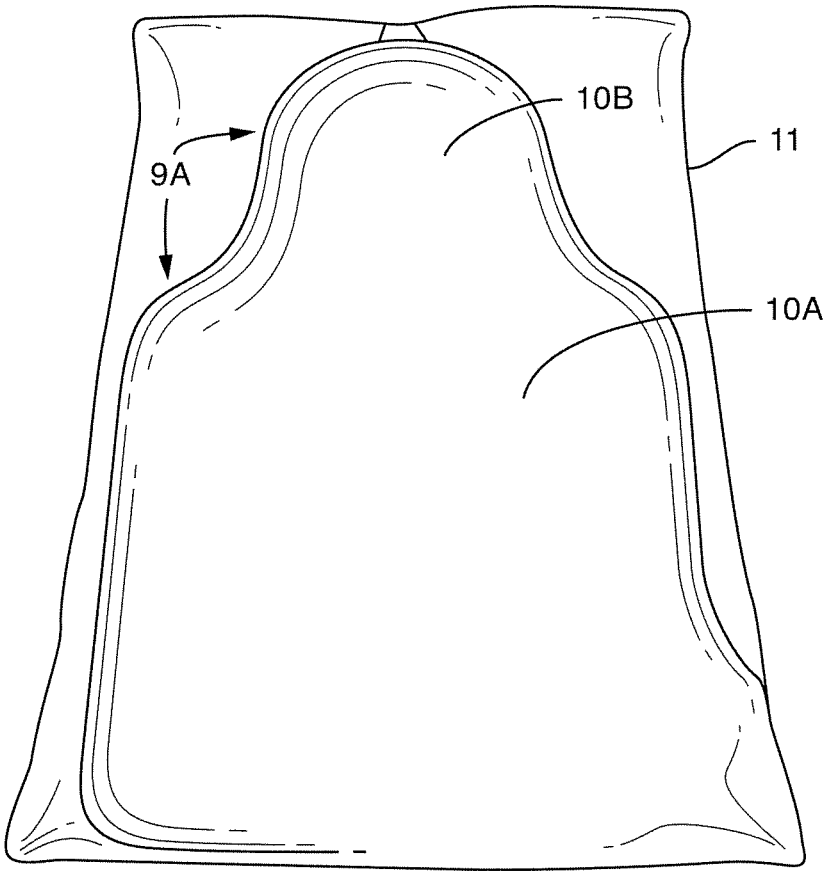
FIG. 1A is a (top view) photograph of one embodiment of a support device comprising a contact surface, with the foam insert (comprising a head cavity) positioned inside the device so as to provide firmness for the infant.
Figure 1B:
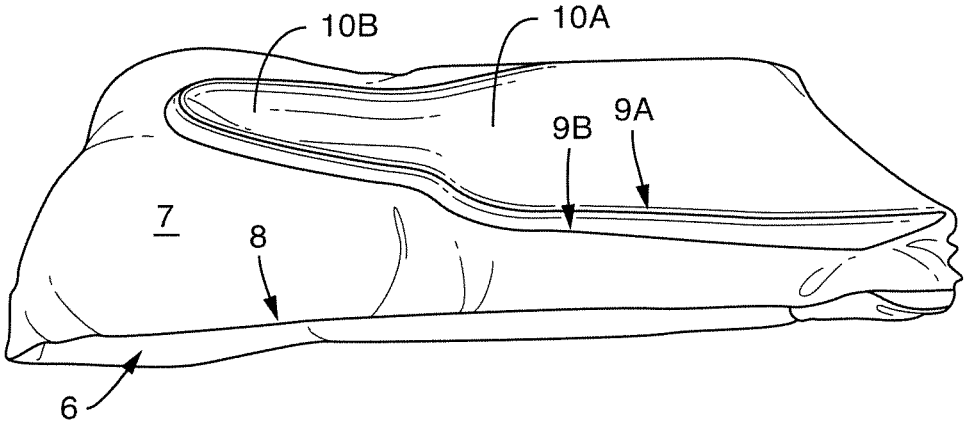
FIG. 1B is a (side view) photograph of the support device embodiment, showing the seam where the top enclosure is attached to the bottom enclosure.
Figure 2:
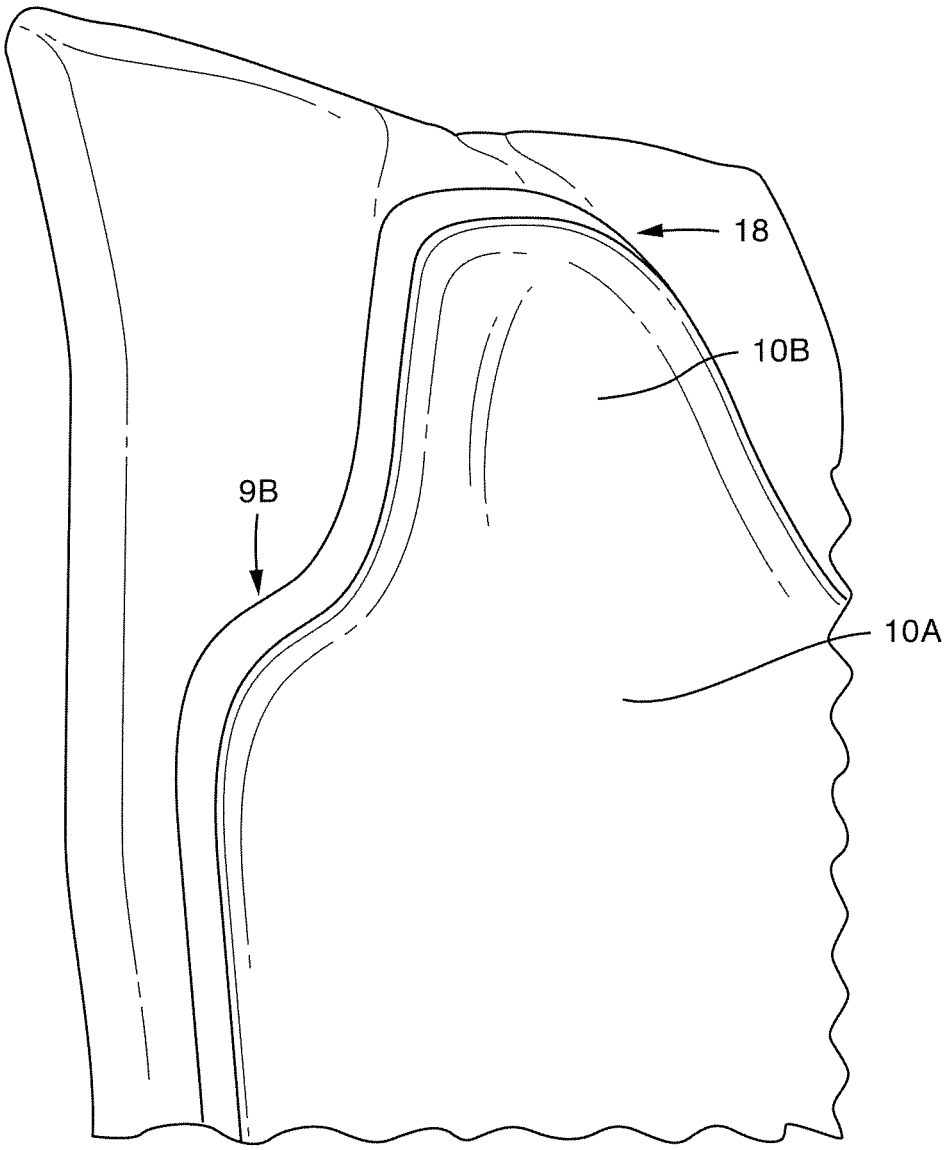
FIG. 2 shows a close-up photograph of the embodiment shown in FIG. 1 to highlight the fact that a boundary can be raised (internal to the edge) using the moveable materials.

FIG. 1A shows a photograph of fabric shape-adjustable contact surface (10A) of one embodiment of an infant support device (11) with the polymer insert (comprising a head cavity) positioned inside the device (the outline of which (9A) can be seen in the Figure) so as to provide firmness for the infant. The fabric contact surface (10B) above said head cavity is shown as a soft depression. FIG. 1B is a (side view) photograph of the support device embodiment, showing the seam (8) where the top enclosure (7) is attached to the bottom enclosure (6). FIG. 1B shows the insert outline (9A) surrounded by a positioning seam (9B), which keeps the insert in place. As shown in FIGS. 1A, 1B and 2, the preferred embodiment lacks a hard base substrate. Instead of a hard plastic base with the foam layers on top, a softer substrate (e.g. fabric, textile or cloth substrate) more of the nature of a pillow (i.e. permitting pressure distortion) is employed. In a preferred embodiment, firmness comes from a solid foam insert (that permits less pressure distortion).

Figure 5A:
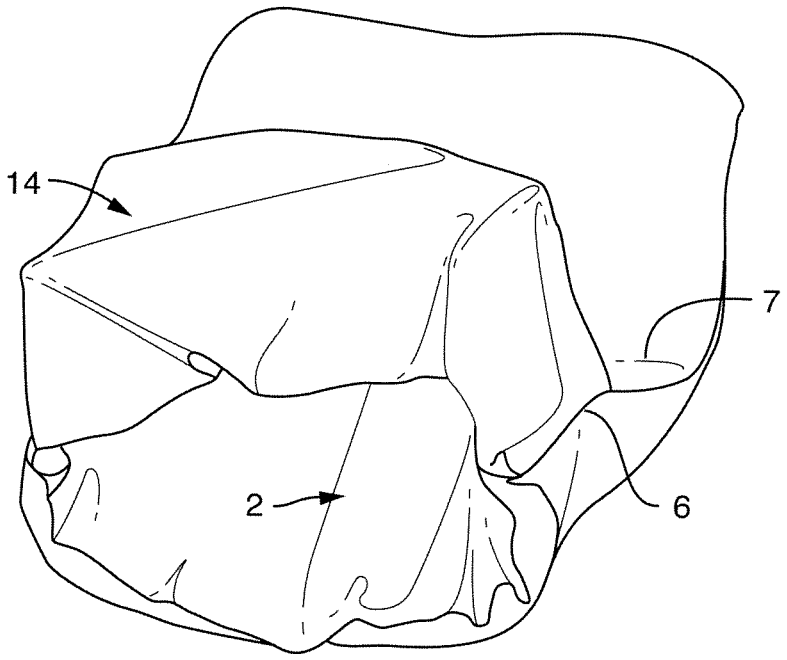
FIG. 5A is a (end view) photograph of one embodiment of a support device, showing the folded edge (or flap) of the top enclosure (7) when opened in preparation for the insertion of a foam insert (not shown). In this position, the opening reveals the shape-adjustable surface of the bottom enclosure (6), along with a compartmentalizing seam or stitch (2) (which allows for substantially equal amounts of moveable material in the two halves of the bottom enclosure).
Figure 5B:
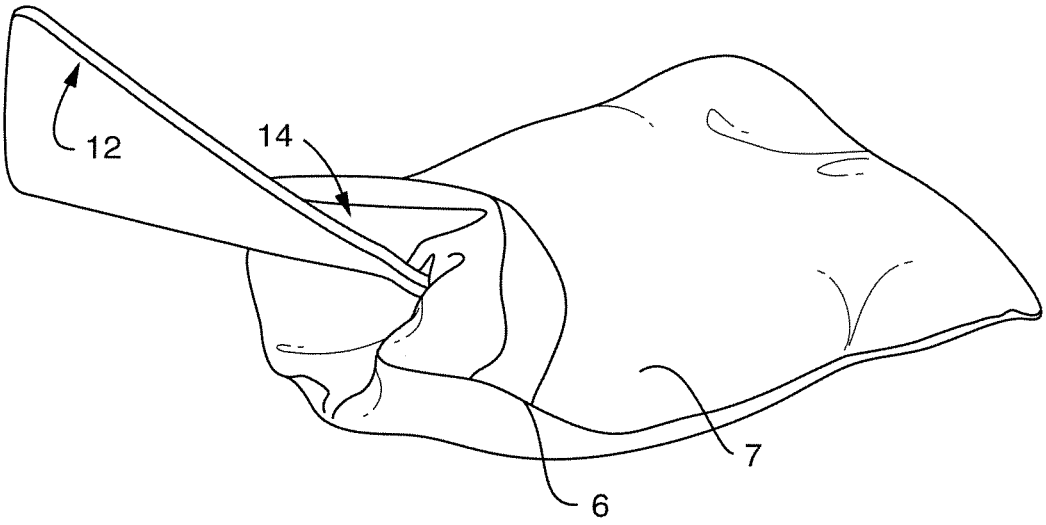
FIG. 5B is a (side view) photograph where the foam insert (12) is shown positioned through the opening caused by the flap (14) for insertion into the device.
Figure 5C:
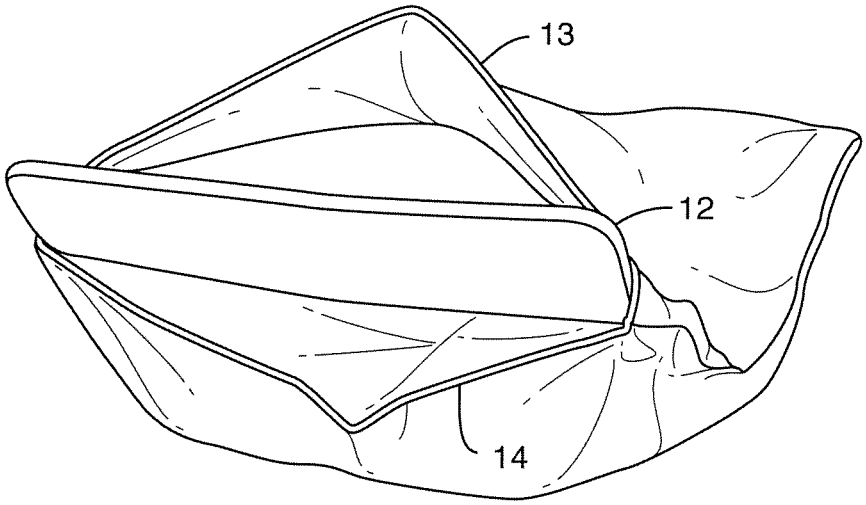
FIG. 5C shows the insertion of a single layer of foam through the edge of the embodiment shown in FIG. 1, highlighting the ease by which such layers can be inserted and removed using the folded edge.

FIG. 5A is a (end view) photograph of one embodiment of a support device, showing the folded edge (or flap) (14) of the top enclosure (7) when opened in preparation for the insertion of a foam insert (not shown). In this position, the opening reveals the shape-adjustable surface of the bottom enclosure (6), along with a compartmentalizing seam (2) in the shape-adjustable surface (note that this surface serves as the floor of the top enclosure). FIG. 5B is a (side view) photograph where the foam insert (12) is positioned through the opening caused by the flap (14) for insertion into the device. FIG. 5C is a (end view) photograph showing the insertion of a single layer of polymer foam (12) through the side (13) of the embodiment shown in FIG. 1, highlighting the ease by which such layers can be inserted and removed using the folded edge (14).

Figure 3A:
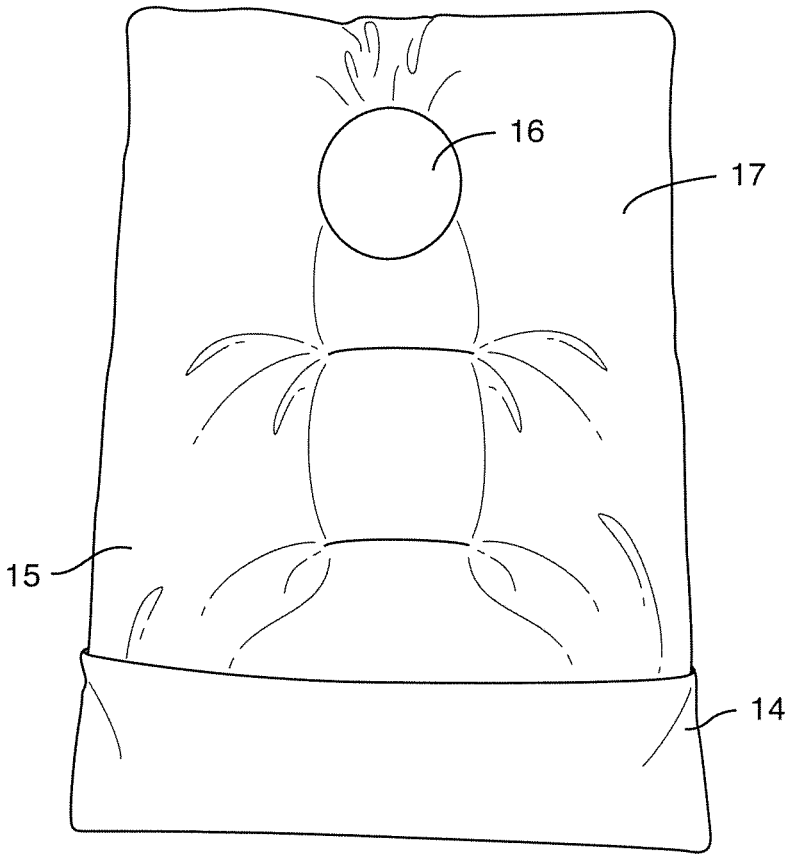
FIG. 3A is a photograph of the bottom surface of the bottom enclosure of the embodiment shown in FIG. 1 highlighting the defined region (containing no moveable materials) and the folded edge which facilitates the insertion of the foam layer.
Figure 3B:
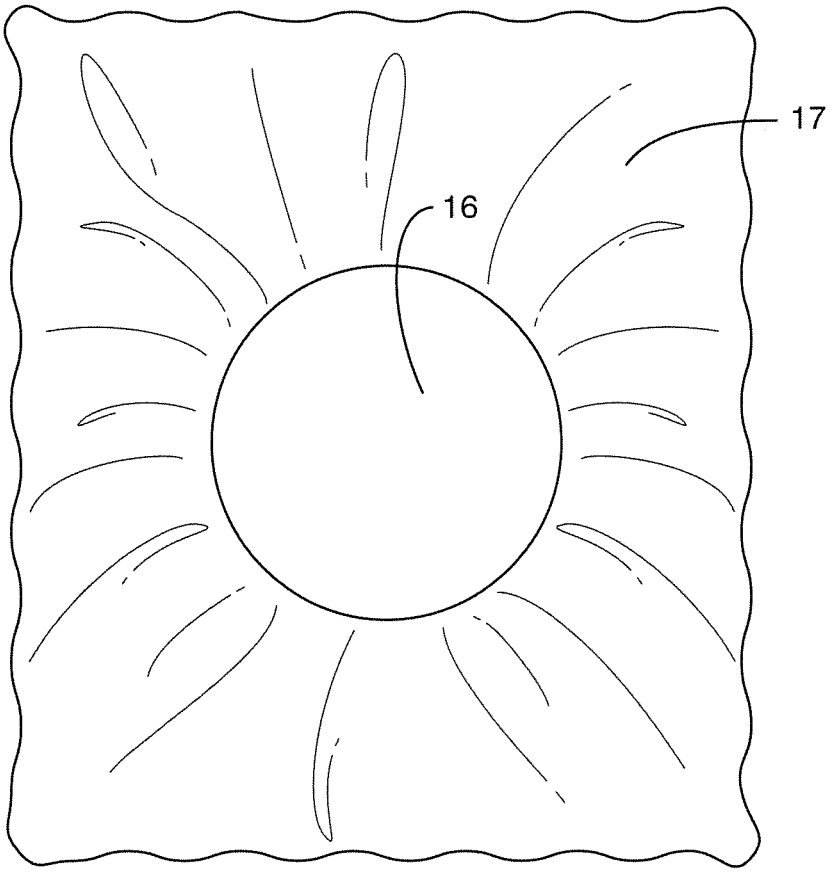
FIG. 3B is a close up view of the defined region (16) (containing no moveable materials).
Figure 4:
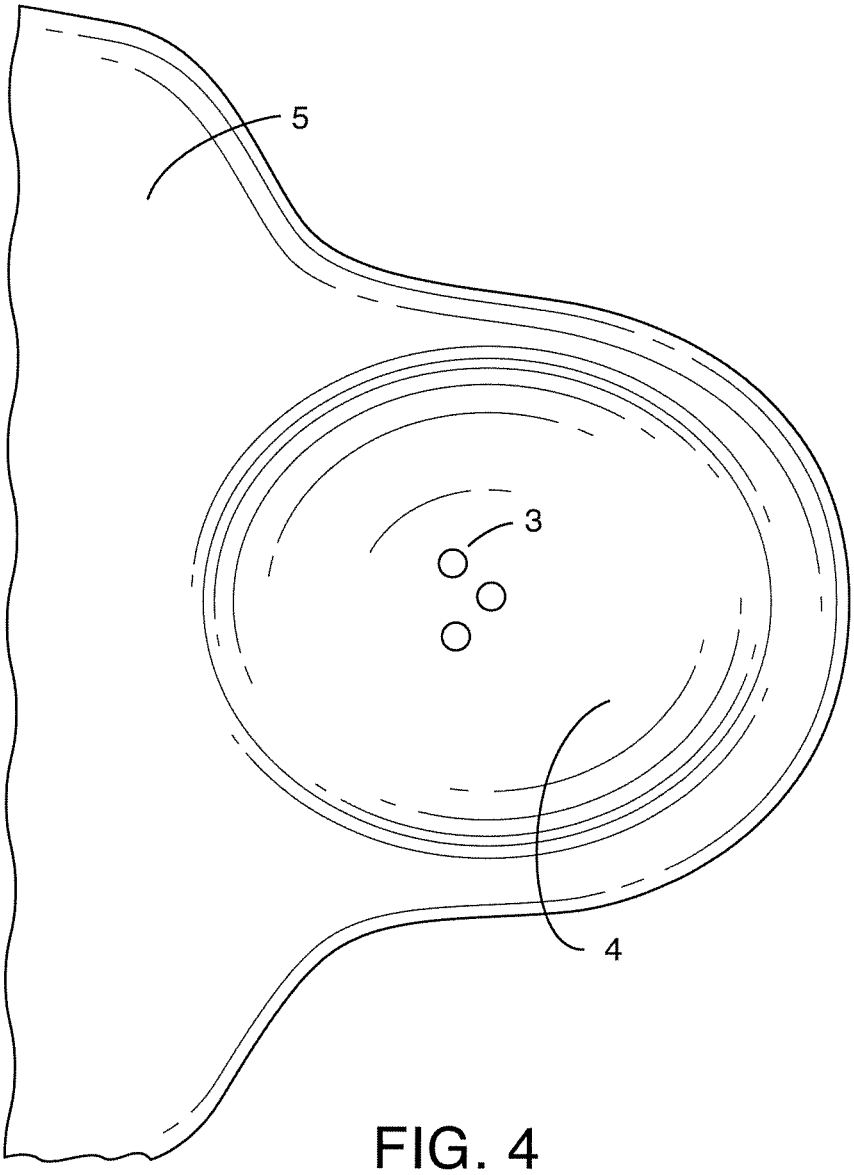
FIG. 4 is a close-up photograph of the top portion of a foam insert (5), comprising a head cavity (4) with perforations (3).

The folded edge (14) is also highlighted in FIG. 3A. FIG. 3A is a photograph of the bottom surface (15) of the bottom enclosure of the embodiment shown in FIG. 1 highlighting the defined region (16) (containing no moveable materials), the surrounding region (17) (containing discrete compressible materials) and the folded edge (14) which facilitates the insertion of the foam layer (when opened) and containment of the foam layer (when closed). FIG. 3B is a close up view of the defined region (16) (containing no moveable materials).

The contact surface (10A) is shown as well as the fabric contact surface (10B) above said head cavity, in an enlarged view (FIG. 2). The discrete moveable materials inside the fabric allow one to foam a raised boundary (18), which can be conforming and customized to the dimensions of at least a portion of the edges of the foam insert and/or said infant (the infant is not shown). In a preferred embodiment, this raised boundary (18), which is shown next to the positioning seam (9B), will remain raised until adjusted (by hand) again.

Figure 8A:
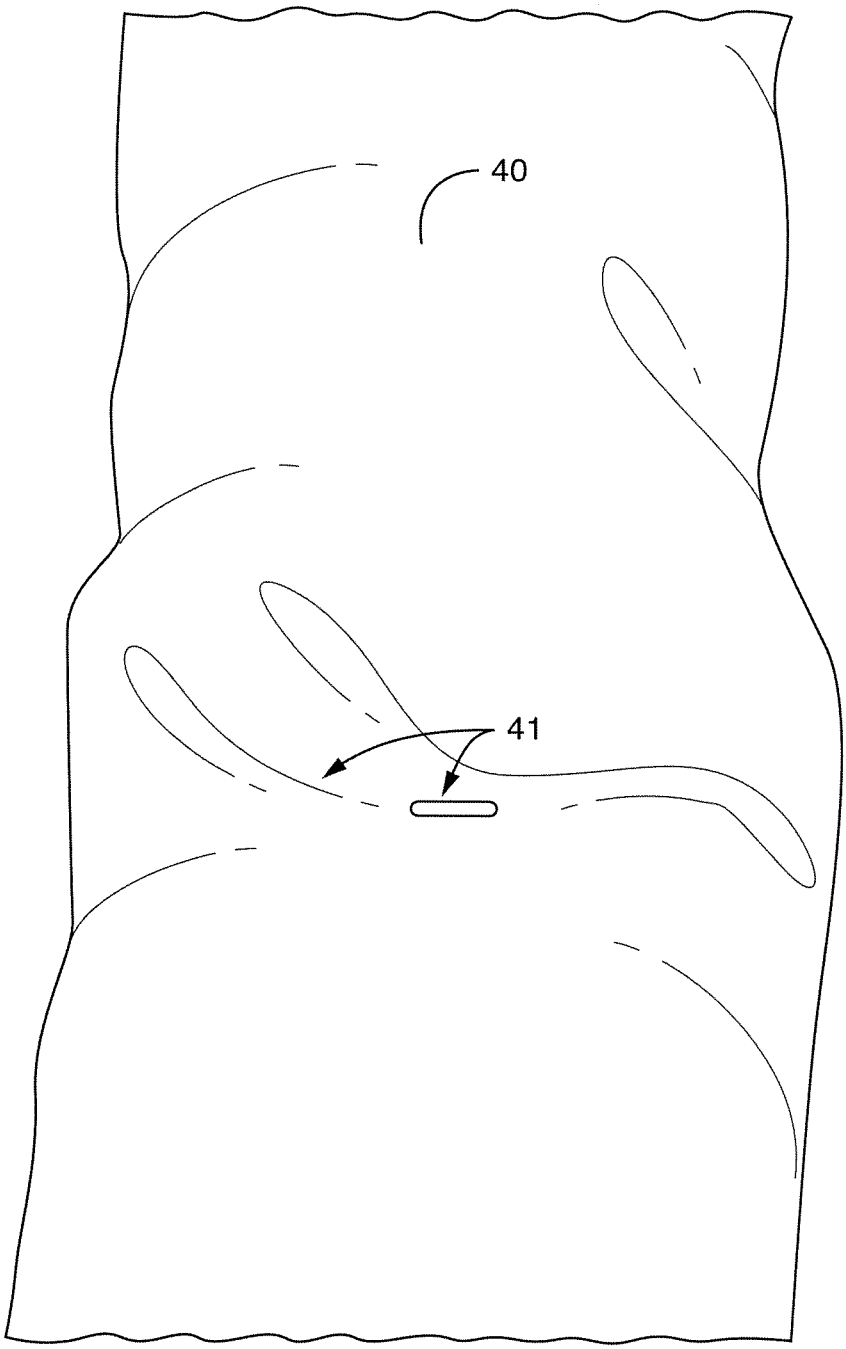
FIG. 8A is a close-up photograph of one arm of one embodiment of an infant containment device, showing a compartmentalizing seam.
Figure 8B:
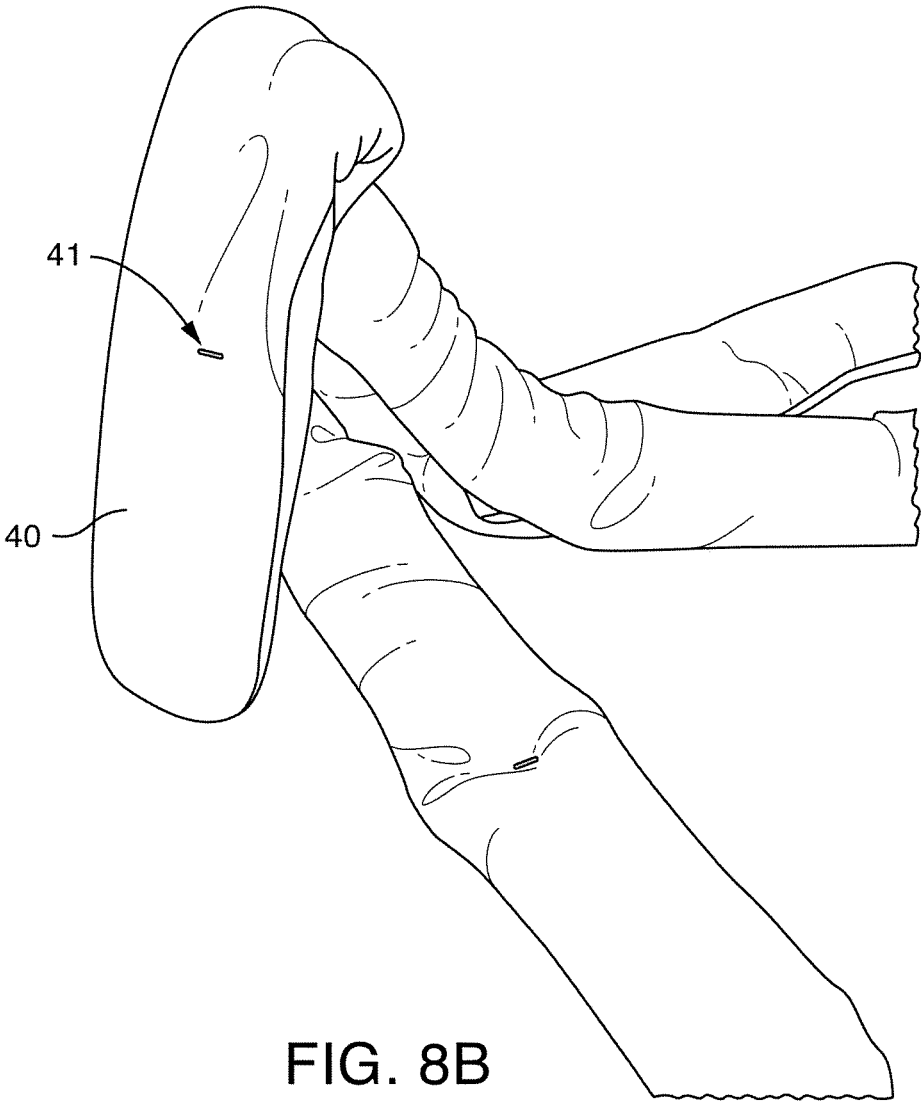
FIG. 8B shows how beads can me moved beyond the compartmentalizing seam so as to load one end of the arm with extra beads.
Figure 8C:
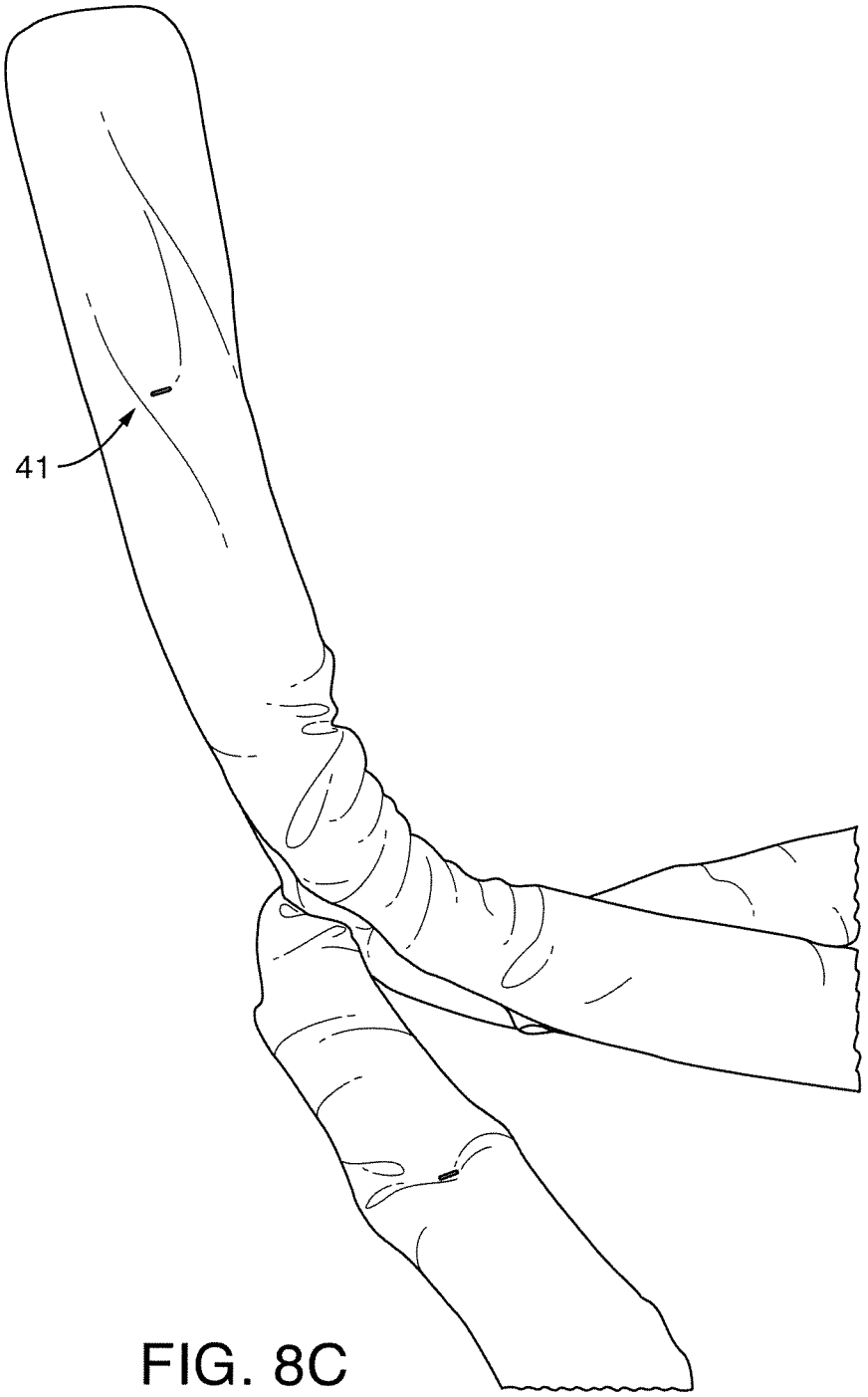
FIG. 8C shows how beads can be moved back through the compartmentalizing seam so as to deplete one end of the arm of beads (relative to other portions of the arm).
Figure 8D:
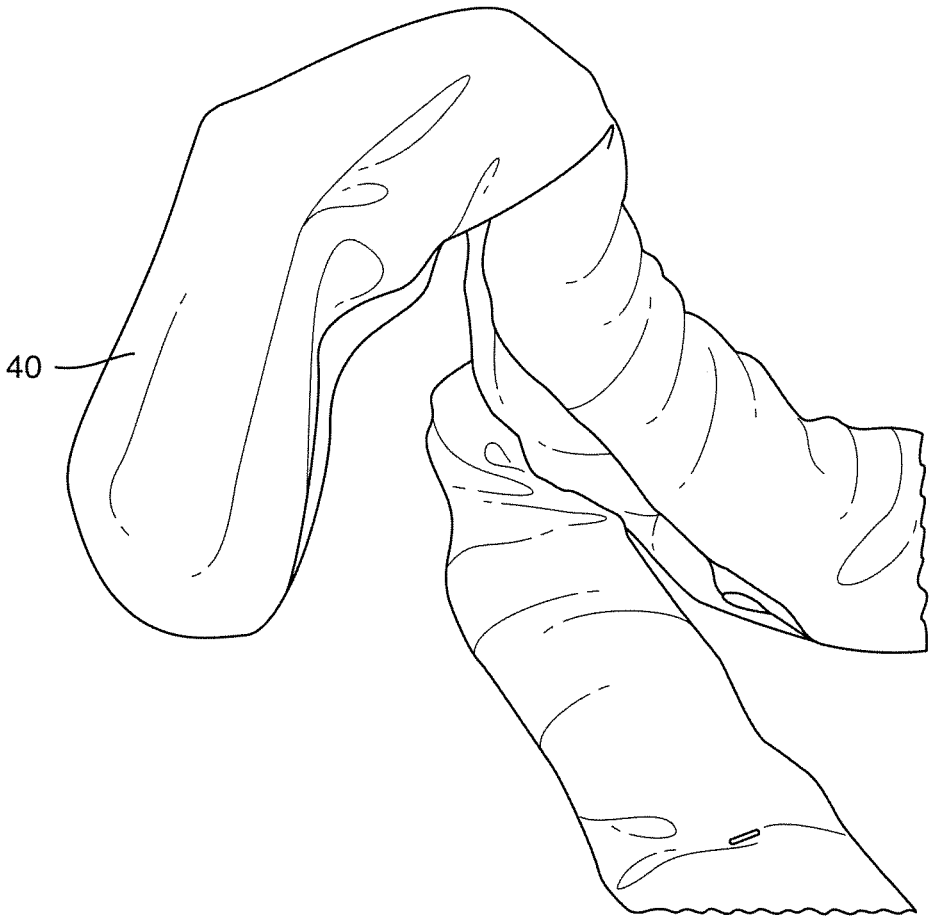
FIG. 8D is a close-up photograph of the end of the arm that has been depleted of beads (relative to the adjacent portion of the arm).

In one embodiment, the present invention contemplates stitches that compartmentalize the compressible materials (e.g. beads) so as to maintain a generally even distribution of these materials. Such compartmentalizing stitches only prevent easy movement; that is to say, beads can be forced around such stitches as illustrated in FIG. 8A-D. More specifically, FIG. 8A is a close-up photograph of one arm (40) of one embodiment of an infant containment device (with a design on the fabric), showing a compartmentalizing stitch (41). FIG. 8B shows how beads can me moved beyond the compartmentalizing stitch (41) so as to load one end of the arm (40) with extra beads. FIG. 8C shows how beads can be moved back around the compartmentalizing stitch (41) so as to deplete one end of the arm of beads (relative to other portions of the arm). FIG. 8D is a close-up photograph of the end of the arm that has been depleted of beads (relative to the adjacent portion of the arm).

Figure 9A:
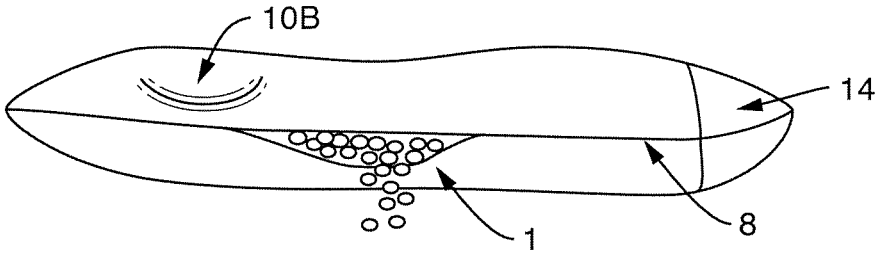
FIG. 9A is a schematic drawing showing a side cutaway revealing the beads retained in bottom enclosure, along with the seam where the top enclosure is attached to the bottom enclosure. The top enclosure shows the depression in the contact surface for the infant's head, along with the flap in a closed position (folded over for closure).

FIG. 9A is a schematic drawing showing a side cutaway revealing the beads (1) retained in the bottom enclosure (of course, the beads are not normally exposed), along with the seam (8) where the top enclosure is attached. Also shown is the fabric contact surface (10B) above the head cavity and the flap (14) in a closed position at the foot of the device.

Figure 9B:
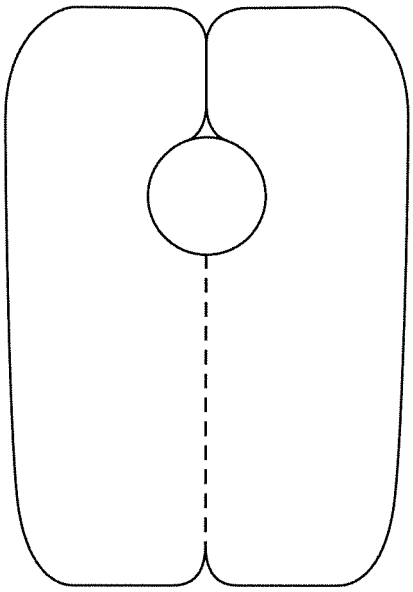
FIG. 9B is a top view schematic drawing of one embodiment of a bladder containing compressible materials (in the shaded area), the bladder fitting around the enclosure (i.e. the defined region lacking compressible materials) where the infant's head will contact the device. In one embodiment, the edges of two portions of the bladder meet, but are not sewn together, allowing it to be easily inserted and removed from the covering.
Figure 9C:
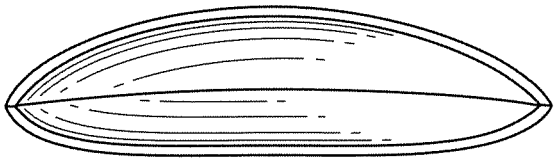
FIG. 9C is a side view schematic drawing showing the opening for the foam insert as well as an opening for inserting and removing the bladder from the bottom enclosure.

In one embodiment, the filled and washed device measures approximately 17 inches in length and 12.5 inches in width. The device size will vary slightly due to shrinkage during routine washing and from movement as the filler can shift in one direction or the other. The device fits easily into any model isolette or crib used in Neonatal Intensive Care Units. This embodiment of the device is made of fabric, batting, and pellet filler. The device weighs approximately 5 lbs. The outer cover is made of 90% cotton, 10% spandex (soft, stretchy) fabric. The selected fabric withstands washing in warm water temperatures and bleaching. The first pocket (FIG. 5A shows this enclosure in the open position) accommodates the molded foam insert (e.g. one of three different sized inserts available from Boston Brace, Avon, Mass.) that are inserted into the device, one layer at a time. Border stitching keeps the insert in place when the device is moved or infant movement occurs. The foam insert facilitates normalized head shape development and maintains the infant in a neutral position when lying supine or semi side-lying. The second pocket (FIG. 3A shows the bottom surface of the bottom enclosure) has a 2⅝ inch circular stitched area, centrally positioned area—approximately 4 inches from the top of the device—to accommodate the depression of the foam insert (when in place). Approximately 0.25 inch batting is enclosed within the circular stitching that provides comfort when the infant is in a prone position. The remainder of the second pocket is filled with compressible pellets (FIG. 9 shows this in a schematic drawing). The pellets serve several purposes. They form a comfortable soft nest or boundary around the infant. They also add weight to keep the device stationary. A stationary device is important as to not cause movement or dislodgement of lifesaving medical devices (such as IV tubing or ventilator tubing) often used in the care of sick infants. They also provide a comfortable place to rest when the infant is positioned prone. A double-layer of fabric covers the backside of the device. The innermost layer is made with a sturdy cotton fabric with limited stretch providing extra durability or structure.

Figure 6:
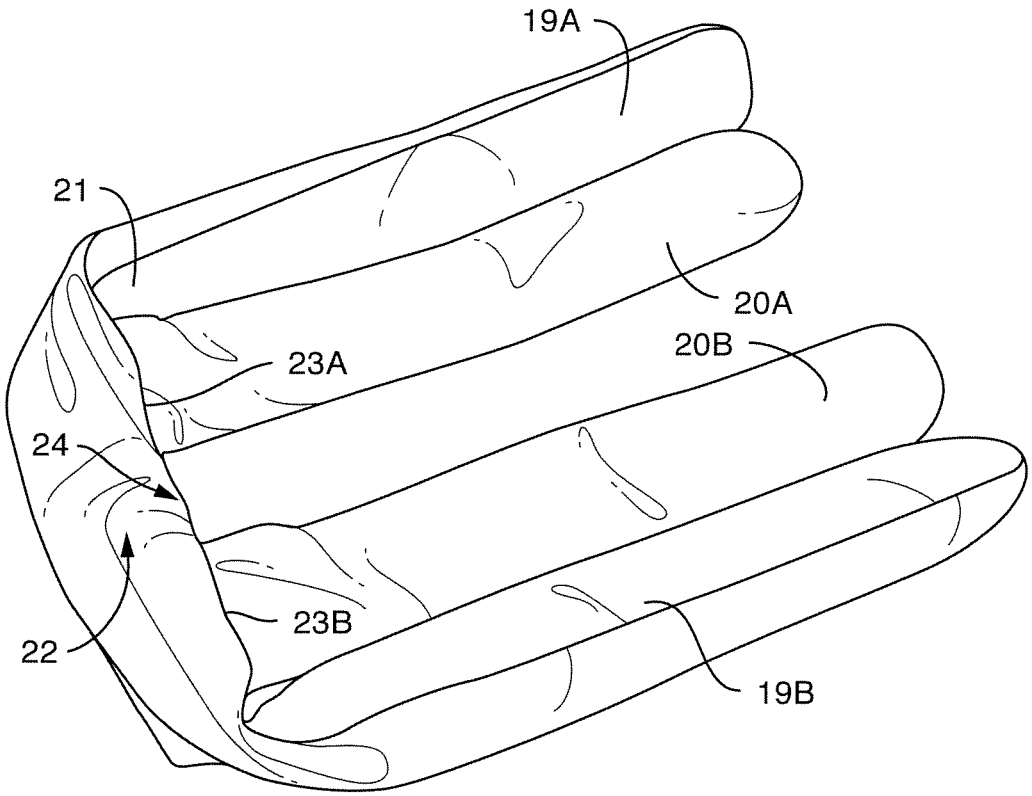
FIG. 6 is photograph of one embodiment of an infant containment device comprising interconnected outer arms and inner arms.

The present invention also contemplates infant containment devices. FIG. 6 is photograph of one embodiment of an infant containment device (21) comprising interconnected outer arms (19A and 19B) and inner arms (20A and 20B). The device (21) comprises first and second (19A and 19B) individually moveable outer arms connected through a middle piece (22), as well as) first and second (20A and 20B) individually moveable inner arms connected to said middle piece (22) at first (23A) and second (23B) junctions, said first and second junctions separated by a space or gap (24) equal to at least half the width (and up to the full width, double width or greater) of either said first or second inner arms, wherein said inner and outer arms comprise compressible material covered in fabric, textile or cloth.

While a four (4) arm embodiment is shown in FIG. 6, other embodiments can have fewer (e.g. three) or greater (e.g. 5 or even 6) numbers of arms. All of the arms need not be connected (although this provides a single convenient unit when all of the arms are connected). The arms are designed to envelope the infant. The two outer arms (19A and 19B) are configured to lie alongside the infant, while the inner (or middle) arms are configured to lay across, on top of the infant to provide containment.

Figure 7:
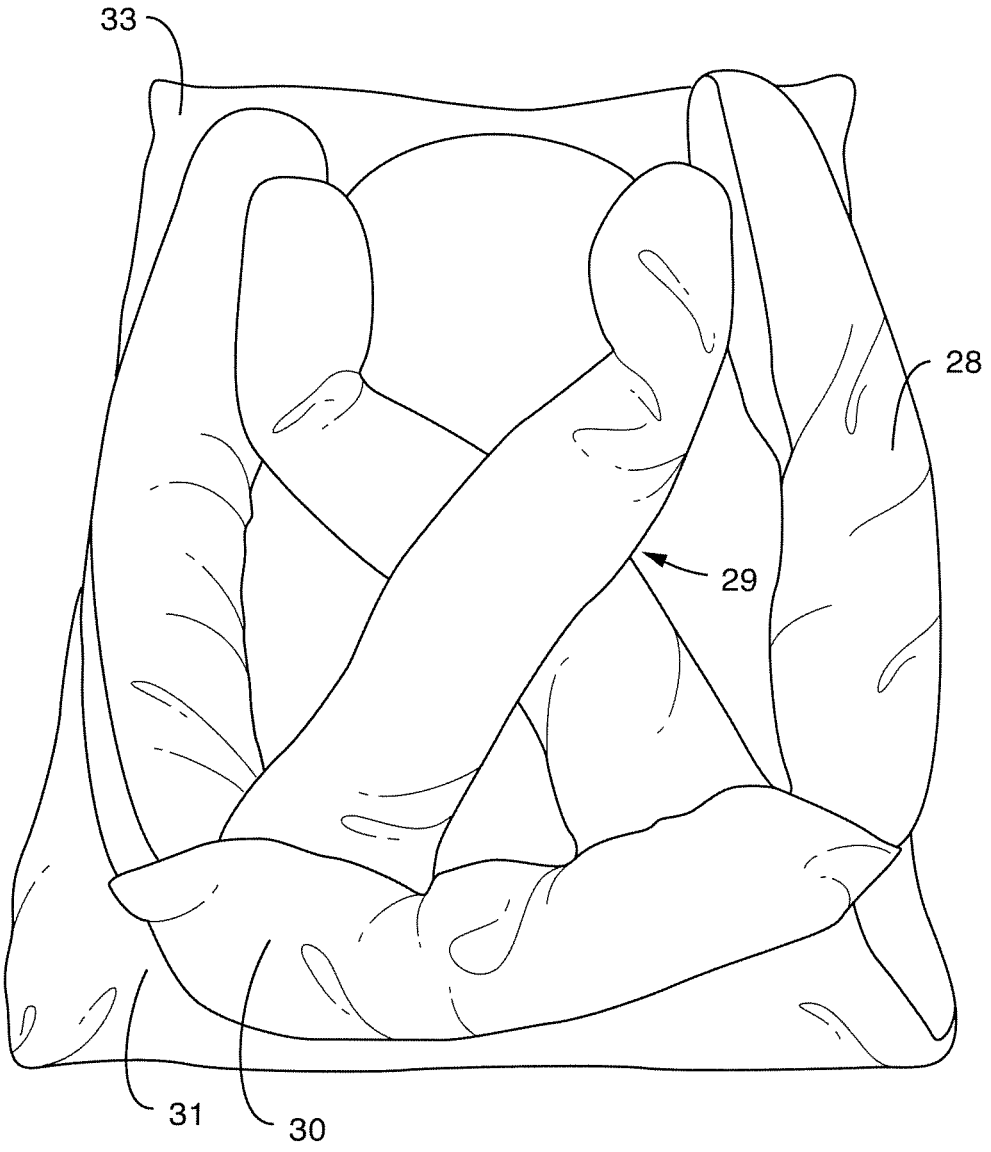
FIG. 7 is a photograph showing the use of both an infant containment device and an infant support device, wherein the containment device is positioned on top of the support device, with the two inner arms crossed and the two outer arms establishing a boundary.

As noted above, the infant support devices described herein can be used alone or in combination with the infant containment devices described herein. FIG. 7 is a photograph showing the use, in combination, of an infant containment device (30) and an infant support device (31), wherein the containment device is positioned on top of the support device, with the two inner arms crossed (29) and the two outer arms establishing a boundary (28). The first and second inner arms can be used to secure the baby from large movement (e.g. in order to perform a procedure, such as putting in an intravenous (IV) line). The outer arms can be used to create a boundary to reduce the chance of the baby sliding or migrating out of or off of an infant support device (e.g. bed, pad, pillow or mattress). At the top of the support device (33) the arms can be around the head (but preferably not over the face or under the head), such as alongside the head or even along the top of the head.

Figure 10A:
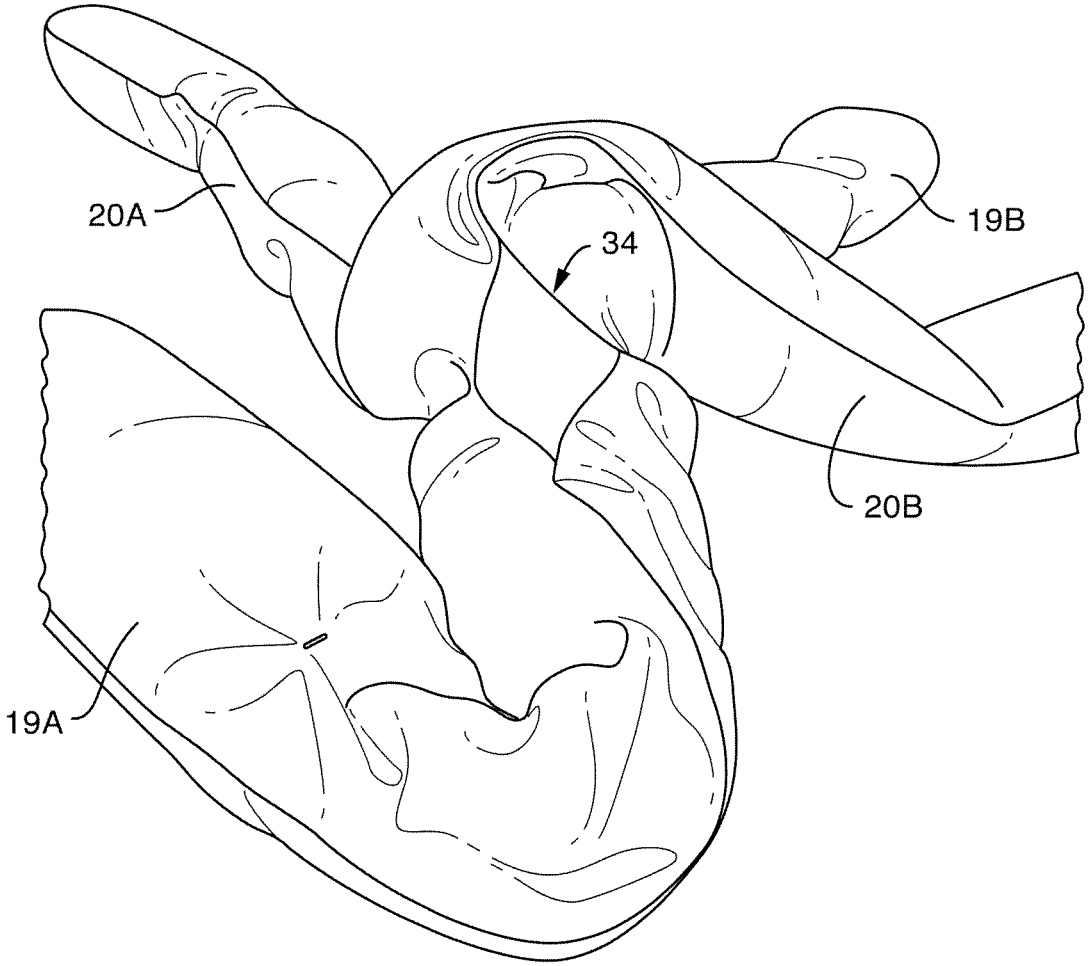
FIG. 10A is side view of one embodiment of an infant containment device showing the four arms as well as the diamond shaped attachment.
Figure 10B:
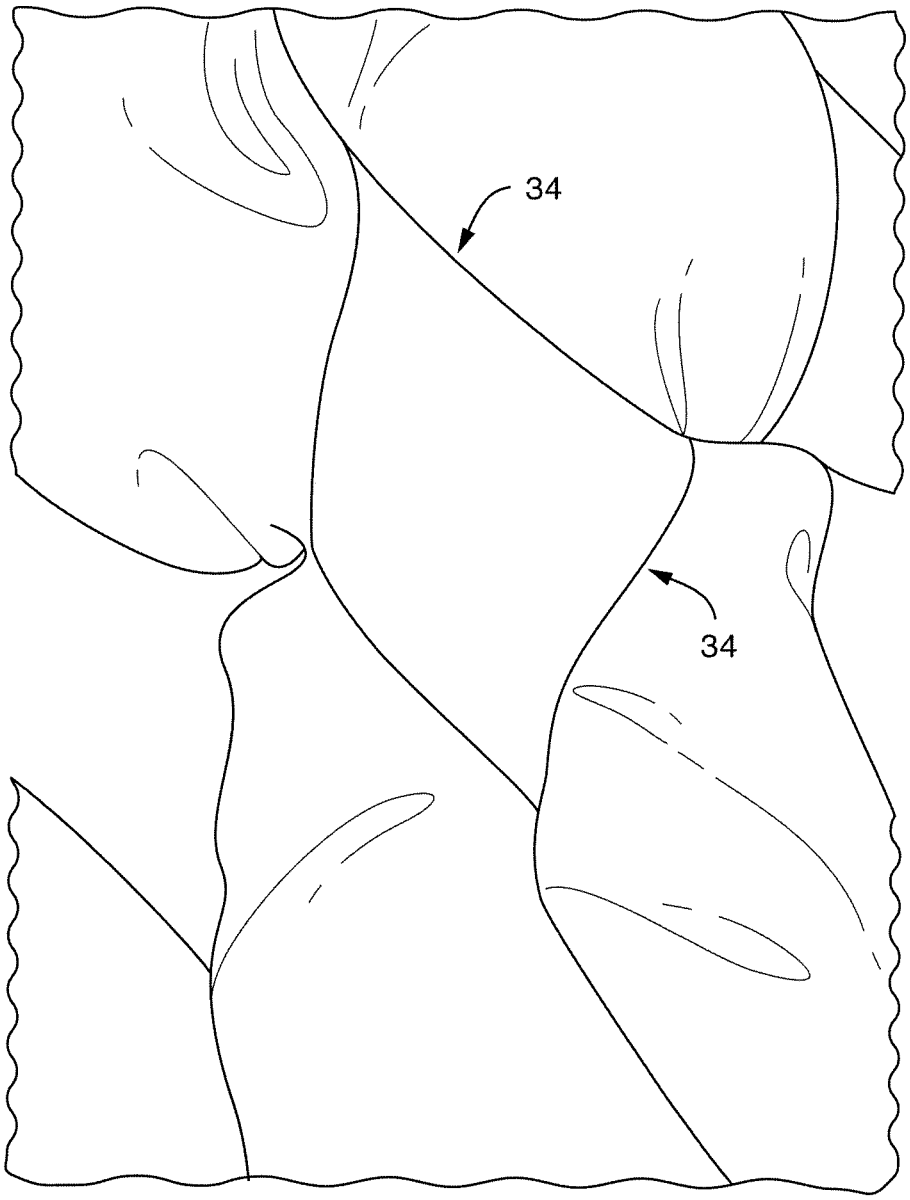
FIG. 10B is a close-up view of the diamond shaped attachment.

It is not intended that the present invention be limited to only particular dimensions for the containment device. The arms or extensions may measure up to 50 inches in length, but more preferably are approximately 40 inches in length. The circumference of each arm or length may measure up to 10 inches, but more preferably 9 inches. In one embodiment, there is a diamond shaped insert (see element 34 of FIGS. 10A and 10B) at the bifurcation of the arms or extensions (19A-B and 20A-B), in order to provide more strength and durability with movement, tugging, and washing. The diamond shaped fabric attachment (34) makes it less likely that the device will come apart during normal use.

The containment device is made of washable material with the moveable materials (compressible beads or pellets) inside the fabric, textile or cloth. In a preferred embodiment, a double layer of fabric is used to ensure durability. The weight of the arms can be controlled by the amount of moveable materials added. For example, in one embodiment, the outer arms comprise more compressible material (e.g. more pellets or beads) than the inner arms. The inner arms can have fewer pellets or beads, so that the weight on the infant is not too great. Each of the four arms, in one embodiment, have compartmentalizing stitches located a third of the way down to prevent constant, non-purposeful shifting of the beads. It was found that the fill (e.g. pellets) was not mobile with the middle two extensions sewn in. For this reason, a different design is preferred.

Example 1

It is not intended that the present invention be limited to a polymer foam insert of a particular type of firmness. In one embodiment, the present invention contemplates Volara type EU foams. Volara type EO foams are flexible, soft to the touch, closed cell EVA copolymer based materials. Type EO foams are ideally suited for use in medical devices and in applications designed for skin and food contact. The conformability and softness of type EO combined with the strength and toughness of a crosslinked EVA copolymer, has made this grade of foam well-suited to the inserts of the present invention. The density range of the product is: 2 to 4 to 6 pounds per square foot (pcf). To evaluate a foam product for potential use with the infant support device of the present invention, it is useful to take into consideration tensile strength and compression strength over the density range of the product. This is shown below in table form:

| | 2 pcf | 4 pcf | 6 pcf |
|---|---|---|---|
| Compression Strength/(ASTM D3575) | | | |
| (lb/sq-in) @ 25% compression | 5 | 8 | 10 |
| (lb/sq-in) @ 50% compression | 13 | 18 | 24 |
| Tensile Strength/(ASTM D3575) | | | |
| (lb/sq-in) Machine Direction | 66 | 141 | 217 |
| (lb/sq-in) Cross-Machine Direction | 46 | 106 | 167 |

This measurement rates the firmness and feel of foam by evaluating its ability to support weight and pressure. These values help categorize materials by placing them along a numerically categorized spectrum.

Example 2

A first prototype was designed with four layers and two separate pockets attached in the middle, with the first pocket for the foam insert and the second pocket for the pellet filler. The device with two layers in the center was bulky.

A second prototype was assembled. It still comprised four layers and two pockets but it was changed so that there is only one middle layer (shown in FIG. 5A as having a compartmentalizing seam, which is optional), with two layers of fabric on the backside (which result in a smoothly finished product. Pocket 1 (the top enclosure) holds the foam insert (see FIGS. 5B and 5C). The inner layer on the backside of pocket 2 (the bottom enclosure) is made of a less stretchy fabric to add durability, especially when being washed. The pellets are sewn permanently into the second pocket (which is fully enclosed), along with a small amount of batting in the round circular area at the head of the device (not shown). This design change allows the pellets to move more freely within the device, decreases bulkiness of the device, allows full benefit (soft bedding for the infant) of compressible (squishy) soft pellets, while still enabling placement and removal of the foam insert.

The foam insert can be held in place with a simple envelope style closure. During the design development, the envelope closure or flap (see FIG. 5A, element 14) was lengthened. If it is too short and shrinks (e.g. during washing), the closure could become non-effective. This device originally measured 15 inches in length and was only 10 inches in width. In the preferred embodiment, the size of the device is increased in both length and width to allow for shrinkage (17.5 inches long and 12.5 inches wide). The preferred overlap for the envelope style closure or flap is stitched on the sides and folds over on to itself, allowing for an unobstructed opening for inserting and removing the foam insert.

Optionally, darts (not shown) could be placed on both sides of the head depression so that the fabric would lay smoothly in the depression of the foam insert. However, given the shallow depression, such bullets are not necessary.

The invention claimed is:

1. A method of containing an infant comprising a) providing an containment device comprising i) first and second individually moveable outer arms connected through a middle piece, ii) first and second individually moveable inner arms connected to said middle piece at first and second junctions, said first and second junctions separated by a space equal to at least half the width of said first or second inner arms, wherein said inner and outer arms comprise compressible material covered in fabric; b) placing said containment device on top of an infant, such that said infant's feet are positioned in said space between said first and second junctions, said infant's torso contacts at least one of said inner arms and the top of said infant's head makes contact with said device; and c) moving said outer arms so as to create a boundary around at least a portion of said infant, wherein said infant has an IV line comprising tubing and said inner arms and outer arms are positioned so as to avoid and make no contact with said IV line.

2. The method of claim 1, further comprising d) introducing an IV line into said infant after step c).

3. The device of claim 1, wherein said compressible materials comprise compressible beads.

4. The device of claim 3, wherein said beads comprise elastomeric polymer.

5. The device of claim 3, wherein said beads comprise thermoplastic elastomeric polymer.

* * * * *